US005346153A

United States Patent [19]

Ebey

[11] Patent Number: 5,346,153

[45] Date of Patent: Sep. 13, 1994

[54] WINCH STRAP ANCHOR

[75] Inventor: Edward W. Ebey, Nashotah, Wis.

[73] Assignee: Fulton Performance Products, Inc., Mosinee, Wis.

[21] Appl. No.: 56,483

[22] Filed: May 3, 1993

[51] Int. Cl.[5] ..... B65H 75/28

[52] U.S. Cl. ..... 242/579; 242/598; 242/614; 254/DIG. 14

[58] Field of Search ..... 242/74, 117; 254/DIG. 14; 24/71.2, 71.3

[56] References Cited

U.S. PATENT DOCUMENTS

| | | | |
|---|---|---|---|
| 1,871,234 | 8/1932 | Proctor | 242/74 |
| 2,508,651 | 5/1950 | Pratt et al. | 242/74 |
| 3,065,838 | 11/1962 | Biedinger et al. | 242/74 |
| 3,214,108 | 10/1965 | Lonzil | 242/74 |
| 3,291,416 | 12/1966 | Gionta | 242/74 |
| 3,323,743 | 6/1967 | Landgraf | 242/68.3 |
| 3,802,641 | 4/1974 | Saito | 242/74 |
| 3,973,740 | 8/1976 | Schankler | 242/68.5 |
| 4,008,863 | 2/1977 | Fohl | 242/107.4 B |
| 4,131,305 | 12/1978 | Lopata | 242/74 |
| 4,305,554 | 12/1981 | Anderson | 242/74 |
| 4,385,736 | 5/1983 | Yamamoto | 242/107 |
| 4,786,007 | 11/1988 | Schoettle | 242/74 |
| 4,955,555 | 9/1990 | Pierson et al. | 242/74 |
| 4,967,976 | 11/1990 | Kawai et al. | 242/74 |
| 5,002,236 | 3/1991 | Cotter | 242/74 |
| 5,125,628 | 6/1992 | Rempinski et al. | 254/323 |

*Primary Examiner*—Daniel P. Stodola
*Assistant Examiner*—John Q. Nguyen
*Attorney, Agent, or Firm*—Edgar A. Zarins; Malcolm Sutherland

[57] ABSTRACT

A winch strap anchor for securing the strap of a winch to the winch drum proximate the hub to maintain a low profile and eliminate crank force irregularities. The anchor is secured to the walls of the drum and is configured to lie against the winch hub thereby minimizing the eccentric winding of the strap onto the winch. The anchor includes a longitudinal slot for receiving the strap to secure the strap to the anchor. The anchor with the strap attached can be manually attached to the winch drum securing the strap.

8 Claims, 2 Drawing Sheets

WINCH STRAP ANCHOR

BACKGROUND OF THE INVENTION

I. Field of the Invention

This invention relates to an anchor for securing the end of a winch strap to the hub to prevent detachment upon full deployment of the strap and, in particular, to a low profile strap anchor which eliminates eccentric winding of the strap and therefore crank force irregularity.

II. Description of the Prior Art

It has long been desirable to secure the interior end of a winch strap to the winch to prevent detachment upon complete deployment of the strap. Such strap winches are used to deploy or draw heavy objects and therefore must be capable of withstanding extreme tensions. At least one application of such winches is the deployment of a boat onto and from its trailer. Thus, it is desirable that once the strap is fully extended it remains attached to the winch to anchor the object secured to the strap. The anchor means also prevents the strap from unwinding from the hub on its own.

The conventional means used to fasten a strap having a sewn loop to a winch drum include a bolt mounted to the winch proximate to the hub and a slotted hub or adapter through which the strap is fed. The bolt means comprises a cross bolt which extends across the hub and is secured to the walls of the winch reel. A nut secures one end of the bolt to the winch wall. The bolt is fed through the strap loop prior to securement such that the loop lies proximate the hub. However, the mere size and bulk of the bolt creates a "hump" or eccentric winding of the strap. In addition to being unsightly, this creates an irregular winch cranking force which is difficult on the user of the winch. Moreover, the cross bolt assembly requires tools for installation and tightening at regular intervals to prevent loss of the nut/bolt.

The slotted hubs or hub adapters eliminate the eccentric winding but require special tools while adding considerably to the cost of the assembly. In the case of the slotted hub, the winch must be disassembled to secure the strap loop to an anchor within the hub. The strap is then fed through a slot in the hub wall and the winch reel can be reassembled. The hub adapter operates on a similar principle by securing the strap loop to the interior of the adapter and feeding the strap through a slot in the adapter. The adapter is mounted to the hub to create a hub of greater circumference eliminating a good portion of the winding space on the winch reel.

SUMMARY OF THE PRESENT INVENTION

The present invention overcomes the disadvantages of the prior known winch strap anchors by providing an easily attachable, low profile anchor which eliminates the eccentric winding of the strap.

The winch strap anchor of the present invention comprises a thin, curved cross plate having a slot along one longitudinal edge. The slot, the winch drum and the strap width must nominally the same in order to accommodate the anchoring system. The plate is fed through the sewn loop of the strap and the strap is inserted into the slot to attach the strap to the anchor plate. The walls of the winch drum include opposing receiving slots proximate the hub of the drum and tangent to the drum. The strap and plate assembly is attached to the winch drum by inserting the ends of the anchor plate into the receiving slots. The curvature of the plate will follow the hub providing a low-profile anchor. The anchor plate has sufficient length to prevent inadvertent withdrawal from the receiving slots as the edges of the strap will limit lateral movement within the winch drum. Thus, the strap anchor provides a simple yet secure method of attaching a winch strap to the winch which creates a negligible crank force irregularity because of its low profile.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
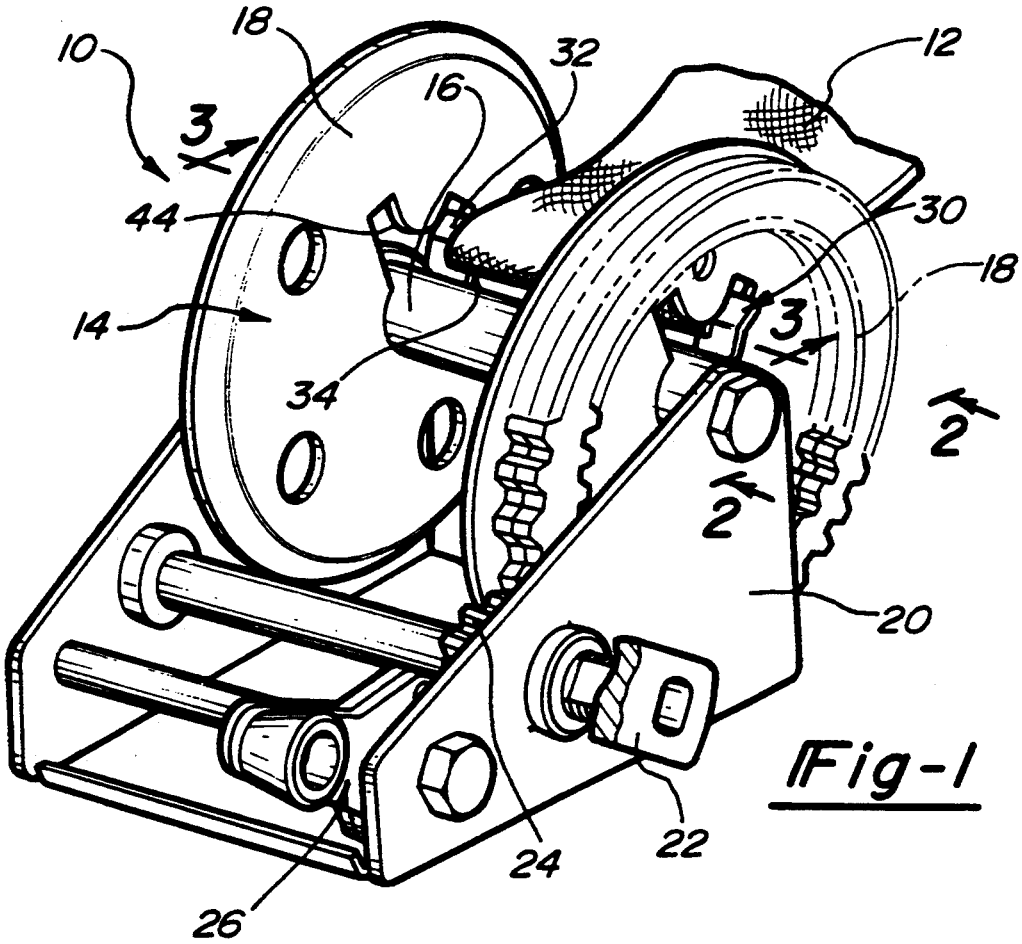
FIG. 1 is a perspective view of a winch embodying the strap anchor of the present invention.
Figure 2:
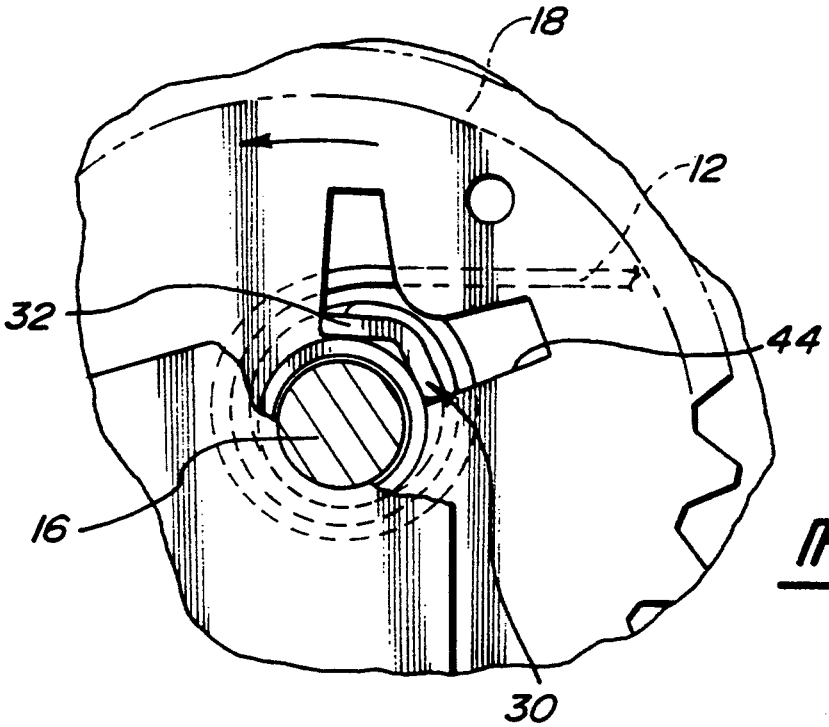
FIG. 2 is a partial enlarged side view of the anchor strap taken along lines 2—2 of FIG. 1.

Referring first to FIG. 1, there is shown a manual winch 10 embodying the present invention for securing a winch strap 10. The drum 14 includes an axial hub 16 and outer walls 18. The winch drum 14 is mounted along its hub to a housing 20 which rotatably supports the drum 14. In the typical winch 10, the drum 14 is rotated to wind or unwind the strap 12 using a crank handle 22 which is operatively connected to the drum 14 through one or more gears 24. A locking lever 26 may also be included to prevent rotation of the winch drum 14 in one or both directions. The lever 26 typically engages one of the gears 24.

The winch 10 operates to wind the strap 12 for pulling an article or vehicle toward the winch 10. The winch housing 20 is typically secured or otherwise mounted to a structure and the crank 22 is used to wind the strap 12 onto the drum 14. The gear ratio between the intermeshed gears 24 of the winch 10 determines the crank force required to wind the strap 12. The crank 22 can also be used to unwind the strap 12 from the drum 14 or the strap 12 may be allowed to freely unwind by disconnecting the locking lever 26 from the gears 24. The locking lever 26 interlocks with the gears 24 to selectively prevent rotation in one direction or the other or to fully release the gears 24 allowing free rotation of the winch drum 14.

The strap 12 is attached to the winch drum 14 by an anchor 30 which maintains the strap 12 in connection with the winch 10 even upon complete unwinding while also allows detachment of the strap 12 and replacement if necessary. However, the primary advantage of the anchor 30 lies in its low profile which eliminates the "hump" or eccentric winding typical of other attachment means. The anchor 30 is constructed of an anchor plate 32 having a transverse curve to conform to the curve of the hub 16. A preferred embodiment of the anchor 30 includes a slot 34 formed along one longitudinal edge 36 of the plate 32. The slot 34 is "T" shaped with opening 38 parallel to the edge 36 of the anchor plate 32. The slot 34 from end-to-end has a length substantially equal to the width of the strap 12 and the distance between the walls 18 of the winch drum 14 in order to snugly retain the strap 12 while eliminating side-to-side travel of the strap 12 during winding.

The anchor 30 is designed to be used with a sewn loop 42 formed on the end of the strap 12. The anchor plate 32 is inserted into the loop 42 and the strap 12 is inserted through the opening 38 into the slot 34 of the anchor plate 32 such that the edges of the strap 12 are secured within the end portions 40 of the slot 34.

Figure 3:
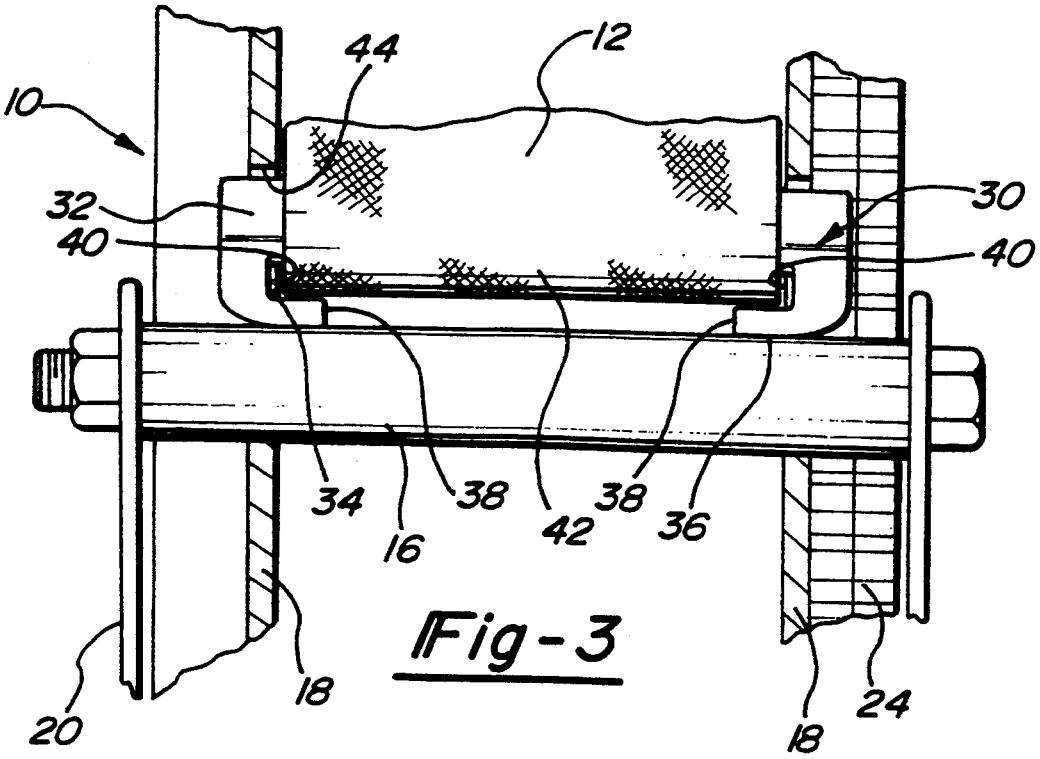
FIG. 3 is a partial enlarged view of the anchor strap taken along lines 3—3 of FIG. 1.
Figure 4:
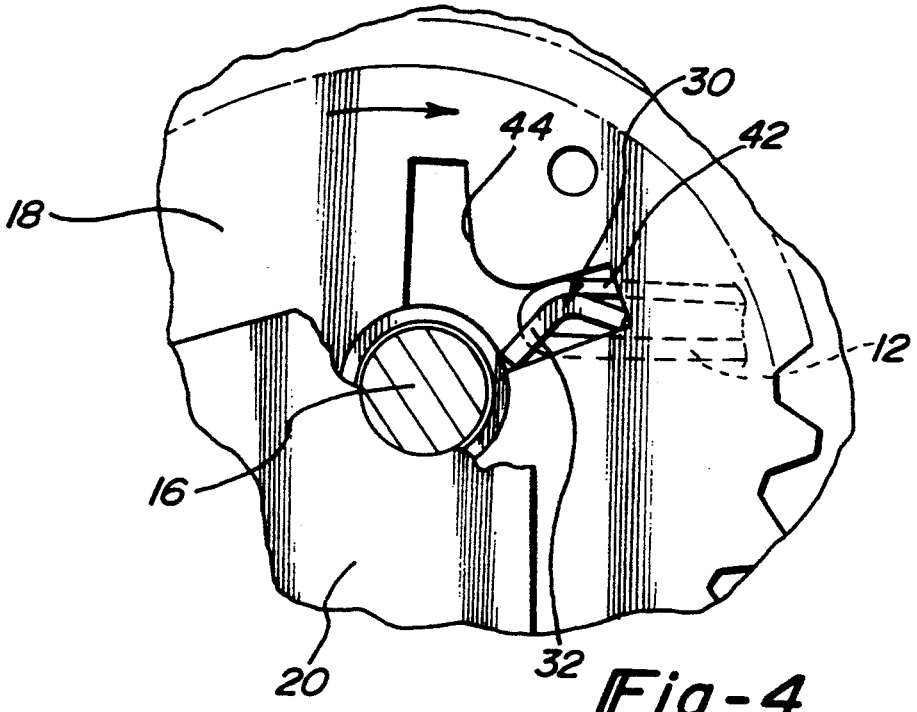
FIG. 4 is an enlarged side view of the anchor strap showing the strap and anchor in full tension.

The anchor 30 is removably retained on the winch drum 14 by inserting the anchor plate 32 into apertures 44 preferably formed in the walls 18 of the winch drum 14. Although the apertures 44 can be as simple as slots to receive the anchor plate 32, in a preferred embodiment, the apertures 44 are V-shaped openings in the drum walls 18. Such openings 44 facilitate insertion of both ends of the anchor plate 32 into both walls 18 of the winch drum 14 in order to retain both ends of the plate 32. Additionally, the V-shape provides a means for preventing disconnection of the strap 12 from the winch 10 by allowing the anchor plate 32 to travel along one leg of the opening 44 upon complete withdrawal as best shown in FIGS. 3 and 4.

The winch strap anchor 30 of the present invention allows simple attachment of a strap 12 which also allows disconnection or replacement of the strap 12. The anchor plate 32 is inserted into the loop 42 of the strap 12. The strap 12 is then inserted into the slot 34 such that the anchor plate 32 is now connected to the strap 12. The plate 32 is inserted into the apertures 44 in the drum walls 18 one end at a time. With the anchor plate 32 lying in close proximity to the hub 16 the strap 12 is wound onto the winch hub 16 by rotating the drum 14. Because of the low profile of the anchor 30 the typical hump or eccentric winding is eliminated. Consequently, irregular winch cranking force is negligible. Furthermore, the anchoring system can be installed without the need for tools.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a winch assembly for winding and unwinding a tie means to pull and deploy a structure, the winch assembly including a selectively rotatable winch drum having an axial hub and a pair of parallel drum walls, the improvement comprising:

an anchor plate for fastening the tie means to the winch drum, said drum walls including aligned substantially V-shaped apertures with the apex proximate said axial hub, the ends of said anchor plate being inserted into said apertures to detachably mount said anchor plate to said winch drum whereby said anchor plate ends can travel along respective arms of the V-shaped apertures, said anchor plate lying in close proximity to the axial hub upon winding the tie means to facilitate substantially concentric winding of the tie means thereby reducing irregular cranking force of the winch assembly.

2. The improvement as defined in claim 1 wherein said anchor plate has a transverse curvature conforming substantially to the axial hub circumferential curvature such that said anchor plate lies in close proximity to the axial hub.

3. The improvement as defined in claim 1 wherein said anchor plate includes a longitudinal slot for receiving the tie means, said slot retaining the tie means on said anchor plate.

4. The improvement as defined in claim 3 wherein the tie means comprises a winch strap having a strap loop at one end, said strap loop inserted into said longitudinal slot to secure said strap to said anchor plate.

5. The improvement as defined in claim 1 wherein said aligned apertures in said drum walls are substantially larger than said plates end, the apex of said apertures proximate said axial hub whereby said anchor plate may travel along respective arms of said V-shaped apertures upon complete unwinding of the tie means.

6. In a winch assembly for winding and unwinding a winch strap having an end loop, the winch assembly including a selectively rotatable winch drum having an axial hub and a pair of parallel drum walls, the improvement comprising:

an anchor plate for securing the winch strap to the winch drum, the drum walls including V-shaped apertures for receiving the longitudinal remote ends of said anchor plate securing said anchor plate and attached strap to the winch drum, the apex of said apertures positioned at the axial hub, said V-shaped apertures of the drum walls being substantially larger than said plate ends such that said anchor plate may travel along respective arms of said V-shaped apertures upon complete unwinding of the tie means, said anchor plate having a longitudinal slot for securing the strap to said anchor plate and a transverse curvature conforming substantially to the curvature of the axial hub whereby said anchor plate lies in close proximity to the axial hub to facilitate substantially concentric winding of the strap thereby reducing irregular cranking force of the winch assembly.

7. The improvement as defined in claim 6 wherein said longitudinal slot is open to one longitudinal edge of said anchor plate facilitating insertion of the winch strap into said longitudinal slot.

8. The improvement as defined in claim 7 wherein said longitudinal slot has a length substantially equal to a width of the winch strap and the distance between the parallel drum walls.

* * * * *